US006045169A

United States Patent [19]

Frolov

[11] Patent Number: 6,045,169

[45] Date of Patent: Apr. 4, 2000

[54] LATCH BOLT SET

[75] Inventor: George Frolov, Farmington, Conn.

[73] Assignee: Harrow Products, Inc., Grand Rapids, Mich.

[21] Appl. No.: 08/860,080

[22] PCT Filed: Apr. 16, 1997

[86] PCT No.: PCT/US97/06174

§ 371 Date: Jun. 17, 1997

§ 102(e) Date: Jun. 17, 1997

[87] PCT Pub. No.: WO97/39214

PCT Pub. Date: Oct. 23, 1997

Related U.S. Application Data

[60] Provisional application No. 60/015,758, Apr. 16, 1996.

[51] Int. Cl.[7] ..... E05B 63/08

[52] U.S. Cl. ..... 292/332; 292/335

[58] Field of Search ..... 292/332, 335, 292/245, 333, 336; 70/141, 143, 145, 151 R, 151 A, 107, 110, 111, 125, 127, 470

[56] References Cited

U.S. PATENT DOCUMENTS

| | | | |
|---|---|---|---|
| 833,267 | 10/1906 | Voight . | |
| 1,133,962 | 3/1915 | Hoglung . | |
| 1,351,686 | 8/1920 | Raccio . | |
| 3,361,464 | 1/1968 | Foster . | |
| 3,375,687 | 4/1968 | Foster . | |
| 3,621,686 | 11/1971 | Klein | 70/157 |
| 3,917,329 | 11/1975 | Fujiki | 292/163 |
| 4,765,663 | 8/1988 | Raymond | 292/169.13 |
| 4,840,050 | 6/1989 | Gotanda | 70/107 |
| 4,854,619 | 8/1989 | Nakauchi | 292/335 |
| 5,469,723 | 11/1995 | Litwin | 70/107 |
| 5,820,177 | 10/1998 | Moon | 292/335 |

FOREIGN PATENT DOCUMENTS

| | | |
|---|---|---|
| 0 588 248 | of 1994 | European Pat. Off. . |
| 44 23 163 | of 1996 | Germany . |
| 2 233 033 | of 1991 | United Kingdom . |
| 2 257 196 | of 1993 | United Kingdom . |

*Primary Examiner*—B. Dayoan
*Assistant Examiner*—Gary Estremsky
*Attorney, Agent, or Firm*—Alix, Yale & Ristas, LLP

[57] ABSTRACT

A latch bolt set has a latch bolt and a trigger bolt assembly comprising a trigger bolt. The latch bolt has a retracted position, a projected position, an intermediate position and is biased to the projected position. The trigger bolt has a retracted first position, a projected second position, and is biased to the second position. An operator retracts the latch bolt from the projected to the retracted position. The trigger bolt assembly engages with the operator to support the latch bolt in the intermediate position when the trigger bolt is in the second position. When the trigger bolt is moved to the first position, the trigger bolt assembly automatically allows the latch bolt to move to the projected position.

25 Claims, 6 Drawing Sheets

LATCH BOLT SET

CROSS-REFERENCE TO RELATED APPLICATIONS

This is the national stage of International Application No. PCT/US97/06174 filed Apr. 16, 1997 which claims priority from U.S. Provisional Application No. 60/015,758 filed Apr. 16, 1996.

BACKGROUND OF THE INVENTION

This invention relates generally to dead bolt lock sets which are employed to secure doors. More particularly, the present invention relates generally to dead bolt lock sets wherein the dead bolt is projectable to an extended position in the strike of the door.

Conventional dead bolts are typically employed alone or in combination with self-latching latch bolts to secure a doorway. The self-latching latch bolt typically has a beveled latch bolt and a spring for biasing the latch bolt in the extended position. Self-latching latch bolts provide the advantage of automatically latching the door when it is closed, and with certain lock mechanisms, automatically locking the door under such circumstances.

Conventional spring biased latch bolts, however, are susceptible to tampering to allow unauthorized access. Tools or other slim items can be slipped between the door and the door frame to engage the beveled edge of the latch and force the latch bolt back into the latch set, thereby allowing the door to be opened. III-fitting doors, or doors that warp or change over time, can become more susceptible to this form of tampering.

Dead bolts have been employed to overcome some of these deficiencies. Dead bolts typically define a squared-off end that is less susceptible to tampering than the beveled end of a typical self-latching latch bolt set. Furthermore, dead bolts are typically not spring loaded, therefore maintaining the dead bolt in an extended position until the lock mechanism is employed to retract it. In addition, dead bolts typically have a longer throw or extension of the bolt for additional locking strength. A deficiency of dead bolts is that they must typically be manually engaged. Furthermore, a dead bolt is usually paired with a self-latching latch bolt, thereby requiring an additional opening in the strike for reception when the door is in the closed position.

SUMMARY OF THE INVENTION

Briefly stated, a latch bolt set in accordance with the invention has a self-latching bolt which is projectable to an enhanced extension or projection position relative to a lock case. The latch bolt set includes a latch bolt and a trigger bolt. The latch bolt has a projected position, a retracted position, and an intermediate position between the projected and retracted positions. The latch bolt is biased to the projected position. The latch bolt is preferably adapted for engagement into a conventional door strike defining a single strike opening. The trigger bolt also has a projected position and a retracted position into the lock case. The trigger bolt is also biased to the projected position. The trigger bolt is configured and positionable so that when the door is closed, the trigger bolt engages the flat surface of the door strike and does not project into an opening in the strike.

An operator assembly retracts the latch bolt from the projected to the retracted position. The operator assembly is typically operated by a door user employing a handle or knob, but can also be operated by other well-known electromechanical assemblies. The operator assembly is further lockable by well known mechanical or electromechanical systems. The trigger bolt assembly engages with the operator assembly to maintain the latch bolt in the intermediate position when the trigger bolt is in the projected position. In a self-latching mode with the door open, the trigger bolt is in the projected position and the latch bolt is in the intermediate position.

The latch bolt is preferably constructed so that a beveled distal portion of the latch bolt extends from the door when the latch bolt is in the intermediate position. The portion of the latch bolt disposed in the latch set in the intermediate position defines a latch plate having a substantially rectilinear exterior engagement surface. The trigger bolt also has a distal beveled portion which extends from the latch set in the projected position. The edge of the door strike engages the bevels of the trigger bolt and latch bolt and drives each bolt to the retracted position when the door swings to the closed position. The trigger bolt assembly disengages from the operator assembly as the trigger bolt is driven to the retracted position. The disengagement of the trigger bolt assembly from the operator assembly allows the latch bolt to extend to the projected position into the opening defined by the door strike when the door is fully closed. In this position, the beveled end of the latch bolt is maintained inside the strike where it is generally inaccessible and therefore is highly resistant to tampering by the use of screw drivers or other slim tools typically surreptitiously employed to retract the latch bolt and thereby unlock the door.

The operator assembly retracts the latch bolt from the projected position to the retracted position, to therefore allow the door to be opened. The trigger bolt returns to the projected position when the door is in the open position, resetting the trigger bolt assembly such that the trigger bolt assembly re-engages the operator assembly. The re-engagement of the trigger bolt assembly to the operator assembly maintains the latch bolt in the intermediate position.

In a further embodiment in accordance with the invention, the latch bolt is locked into the projected position whereby the latch bolt can practically be retracted only by the operator assembly. A lock bar engages the latch bolt to prevent the latch bolt from being moved to the intermediate or retracted positions. The lock bar prevents potential unauthorized entry by maintaining the latch bolt in the projected position despite the presence of a countering force on the latch bolt applied by a tool or other object. The operator assembly disengages the lock bar to retract the latch bolt.

An object of the invention is to provide a new and improved selflatching latch bolt assembly for efficiently securing a door to a door frame.

Another object of the invention is to provide a new and improved latch bolt set having a latch bolt which is positionable at an intermediate position for self-latching and a projected position for locking.

A further object of the invention is to provide a new and improved latch bolt set which implements a high level of security and is highly resistant to tampering.

These and other objects and advantages of the invention will become apparent from the following specification and the drawings.

DETAILED DESCRIPTION OF THE PREFERRED EMBODIMENT

Figure 1:
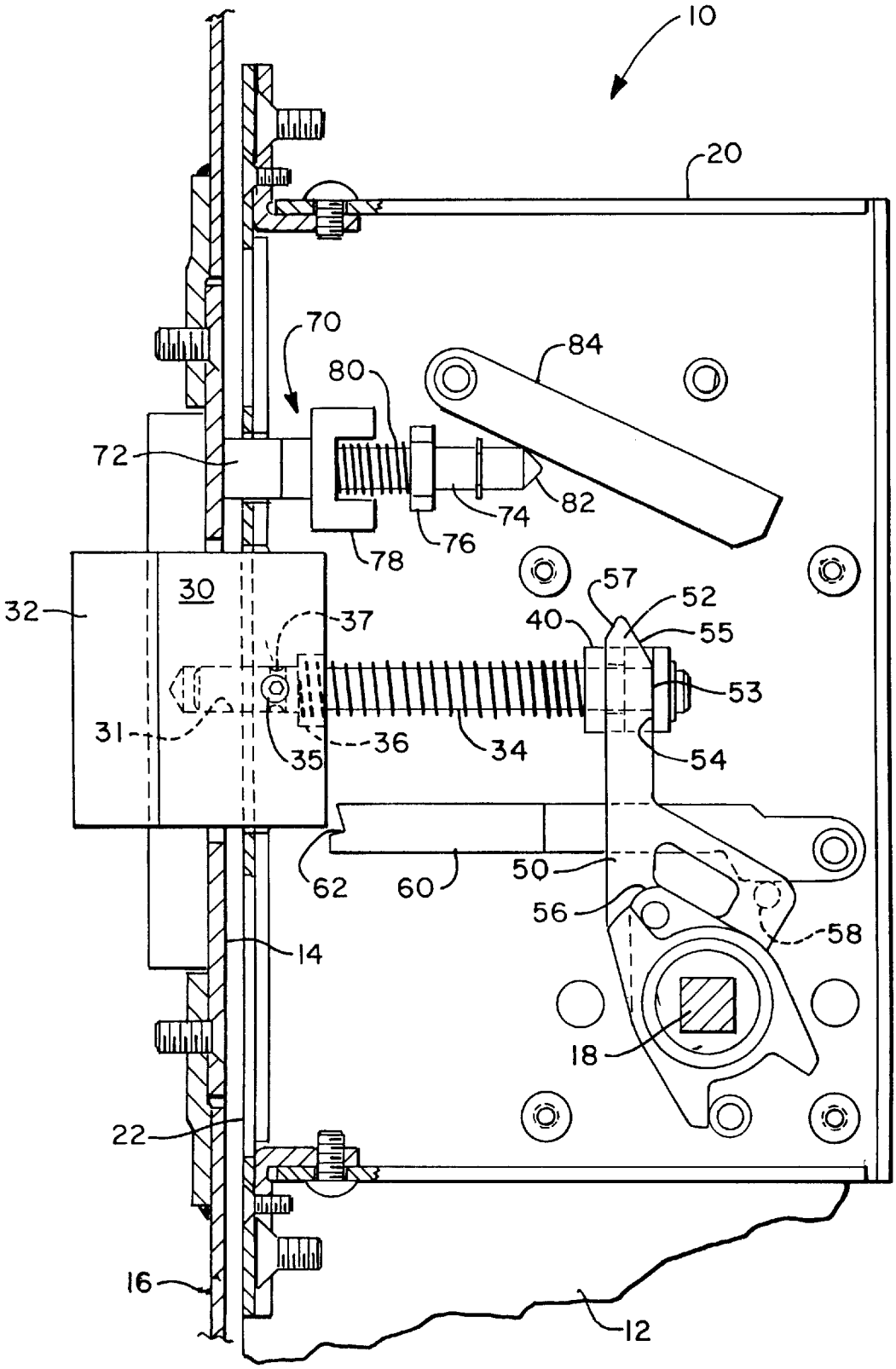
FIG. 1 is a side sectional view, partly in phantom and partly broken away, of a latch bolt set and a strike for a configuration wherein the door is closed and the bolt is fully projected.

With reference to the drawings wherein like numerals represent like parts throughout the figures, a latch bolt set in accordance with the present invention is generally designated by the numeral 10. The latch bolt set is mounted in the mortise of a door 12 and is adapted to engage the strike 14 of a door frame 16. The strike 14 may be bi-handed, i.e., suitable for use for either a left- or right-handed door installation. A latch operator, such as a lever, door knob or other conventional operator (none illustrated), connects via a spindle 18 for operating the latch set. The latch bolt set may be employed with a conventional mechanical door operator or an electronic door operator having an automatic clutch mechanism, such as disclosed in co-pending U.S. Application Ser. No. 08/524,349 filed Sep. 6, 1995.

The latch set 10 is operable to throw the latch bolt to an extended projected position when the door is closed and also to provide a lock bar to prevent the latch bolt from being improperly retracted when the door is closed and properly latched. The latch set is also adapted to be bi-handed, i.e., easily convertible for use in connection with either a left- or right-handed door installation.

The latch set comprises a substantially rectangular case 20 which provides a mounting frame for the components as well as a protective housing and a support for mounting the latch set in the mortise of a door. The case 20 has a frontal faceplate 22. The faceplate 22 is disposed in opposing parallel relationship to the strike 14 when the door 12 is closed.

The latch bolt 30 is a generally trapezoidal member (as viewed from the top) having a beveled forward tip 32. The latch bolt has a central bore 31 which receives a forward end portion of a throw rod 34. The latch bolt may be threaded to the throw rod 34 or secured by a set screw 35 which is received in a recess 37 of the rod. A counter bore 36 at the rear end of the bolt 30 receives the forward end of a spring 38 which is secured at the opposing end by a stop 40 fixedly mounted to the case to provide a support for the slidably received throw rod 34. The spring functions to bias the latch bolt to the protected position into the strike.

Figure 2:
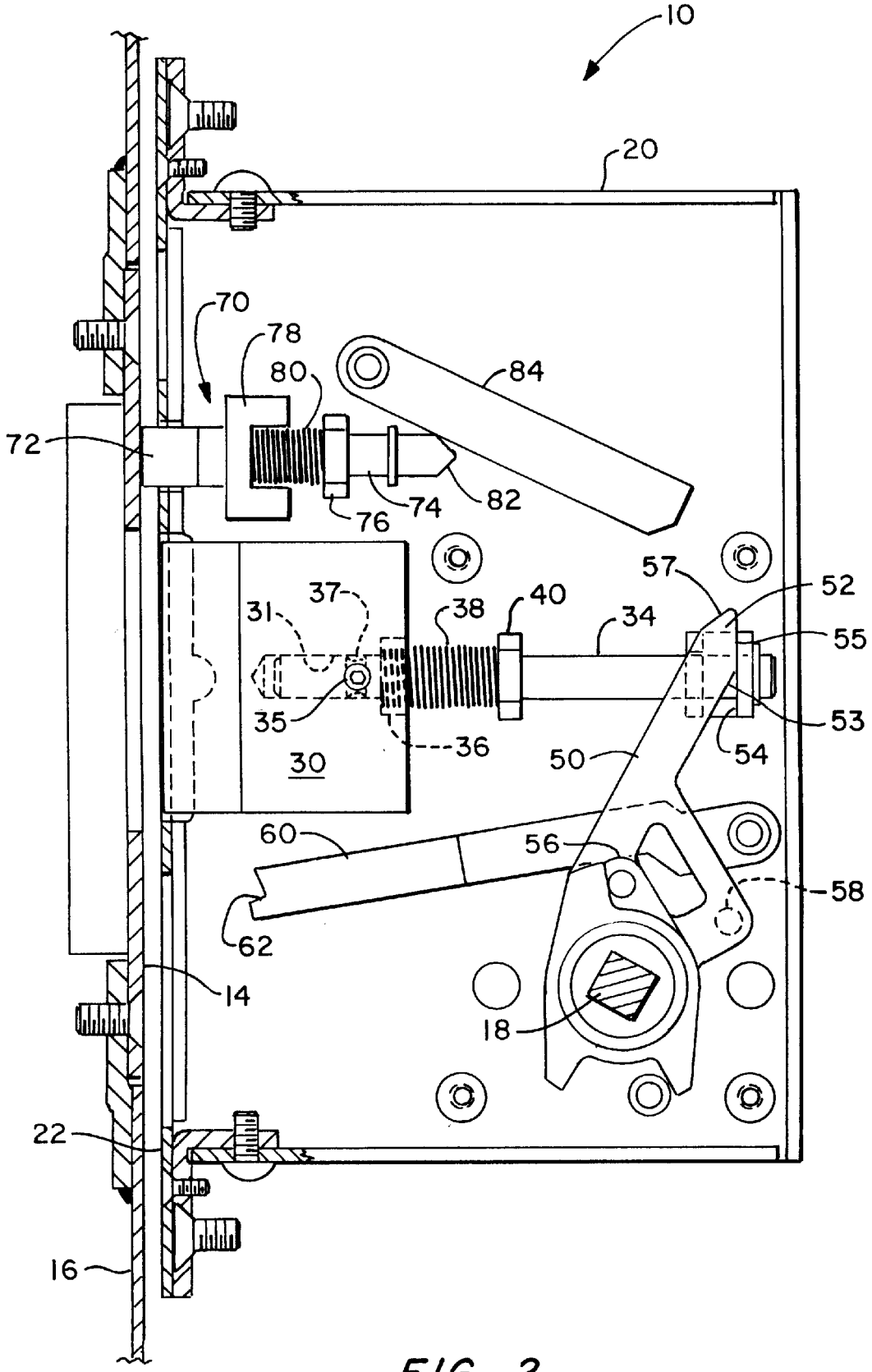
FIG. 2 is a side sectional view, partly in phantom and partly broken away, of the latch bolt set and strike of FIG. 1 for a configuration wherein the door is closed and the inside or outside lever is engaged and depressed.
Figure 3:
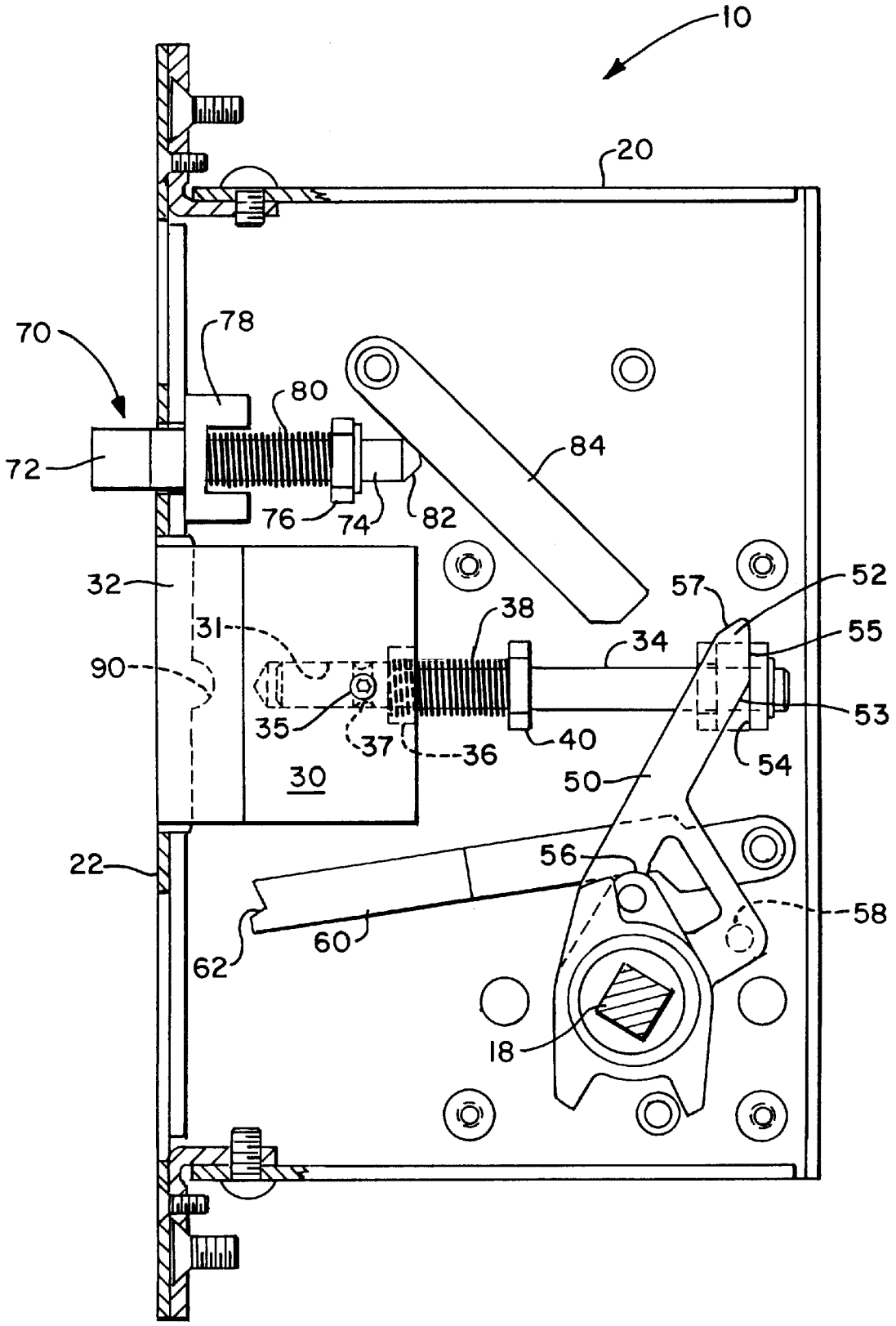
FIG. 3 is a side sectional view, partly in phantom and partly broken away, of the latch bolt set of FIG. 1 for a configuration wherein the door is open and the inside or outside lever is depressed.

A lever arm 50 having an angled distal engagement end 52 is mounted for rotation with the operator spindle 18. The engagement end 52 has two angled surfaces 53, 55 which engage against a shoulder 54 fixedly mounted to the throw rod 34 for retracting the latch bolt 30. As best illustrated by comparing FIG. 1 and FIG. 2, the surfaces 53, 55 engage the shoulder 54 in surface-to-surface relationship to define stable extreme projected and retracted positions of the latch bolt 30. A cam 56 and a guide pin 58 are mounted in fixed relationship with the lever arm for engagement with a lock bar 60. The lock bar is pivotally mounted to the case and includes a distal notch 62 which is engageable with the lower corner of the latch bolt to prevent the latch bolt from being improperly retracted into the latch bolt case when it is in the projected position as illustrated in FIG. 1. In the activated lock bar position illustrated in FIG. 1, the lock bar surface is supported in a generally horizontal orientation by the guide pin 58. When the lever arm 50 is rearwardly rotated by the operator, the guide pin 58 disengages from the lock bar 60 which pivots to engage and rest on the cam 56 as best illustrated in FIG. 2.

Figure 4:
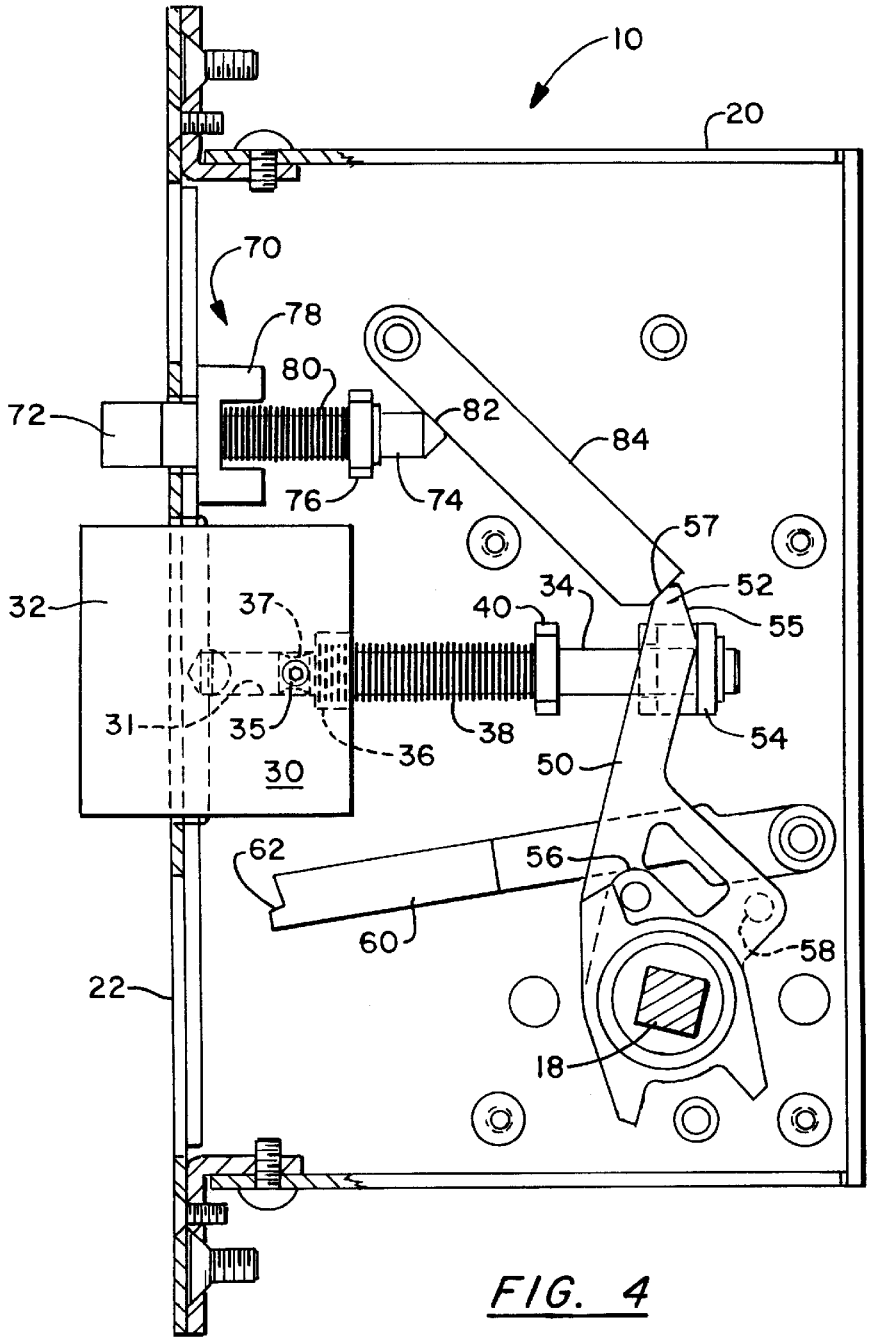
FIG. 4 is a side sectional view, partly in phantom and partly broken away, of the latch bolt set of FIG. 1 for a configuration wherein the door is open and the inside or outside levers are disengaged and in a neutral position and the latch bolt is in a self-latching position.
Figure 5:
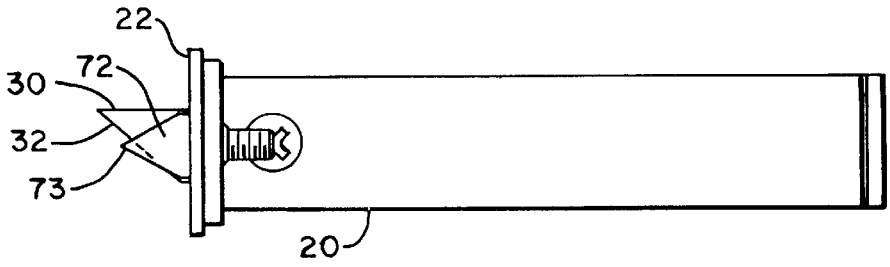
FIG. 5 is a top plan view, partly in phantom, of the latch bolt set of FIG. 4.

A trigger bolt assembly 70 comprises a trigger bolt 72 which is operatively mounted to a trigger rod 74. The trigger rod 74 slides in a bracket 76 along an axis parallel to the throw rod 34. The bracket 76 is fixed relative to the case. The outer portion of the trigger bolt has a bi-beveled tip 73 (FIG. 5). A cup-like retainer 78 is fixedly mounted to the trigger rod for retaining a spring 80 which biases between the fixed bracket and the retainer 78 to bias the trigger bolt to a full projected position as illustrated in FIG. 4. The inner (rear) end 82 of the trigger rod 70 is tapered to facilitate engagement with the underside of a lever 84. When the trigger bolt engages the strike, the spring 80 is compressed between the retainer and the bracket as illustrated in FIGS. 1 and 2, and the lever 84 rests on the end 82 of the trigger rod.

When the operator is released, the engagement arm 50 is biased to pivot counterclockwise as illustrated in the drawings and an angled surface 57 of the engagement end 52 engages the distal end of the lever 84 as illustrated in FIG. 4 so that the latch bolt 30 is in a stable self-latching (intermediate) position as best illustrated in FIG. 4. When the door is closed and the trigger bolt engages the strike, the trigger rod 74 is forced rearwardly to disengage (upwardly pivot) the lever 84 from the engagement with the lever arm 50, thereby forwardly forcing the throw rod 34 and the latch bolt 30 to the extreme projected position which is typically one inch from the faceplate 22 of the latch bolt case as best illustrated in FIG. 1. In the self-latching position, the latch bolt is typically projected approximately one half inch from the faceplate 22.

It will be appreciated that the latch bolt set has application in conjunction with the conventional mechanical door operators or sophisticated electronically controlled door operators. As illustrated in FIG. 1, when the door is closed, the latch bolt 30 is projected to the extreme projected position under the bias of the throw spring 38. The lock bar 60 is positioned to prevent tampering with the latch bolt 30 by withdrawing the latch bolt into the lock case. The trigger bolt 72 is in a retracted position due to the engagement against the face of the strike.

With reference to FIG. 2, when the door is closed and the operator lever is engaged and depressed, the engagement arm 50 rearwardly pivots to retract the latch bolt 30. The trigger bolt 72 remains in the compressed retracted position. When the door is open, the trigger bolt projects forwardly under the bias of the trigger spring 80 and the lever 82 pivots clockwise downwardly. The compression spring 38 forces the latch bolt 30 forwardly to the intermediate self-latching position which is defined by the engagement of the lever 84 with the engagement arm 50 as best illustrated in FIG. 4. In a self-latching position, the latch bolt is typically projected approximately a half inch, and the lock bar 60 pivots downwardly to permit the inward retraction of the latch bolt.

When the door is closed, then the trigger bolt 72 and rod 74 are forced rearwardly to disengage the lever 84 from arm 50 which allows the engagement arm 50 to pivot forwardly to the projected latch bolt position of FIG. 1.

Figure 6:
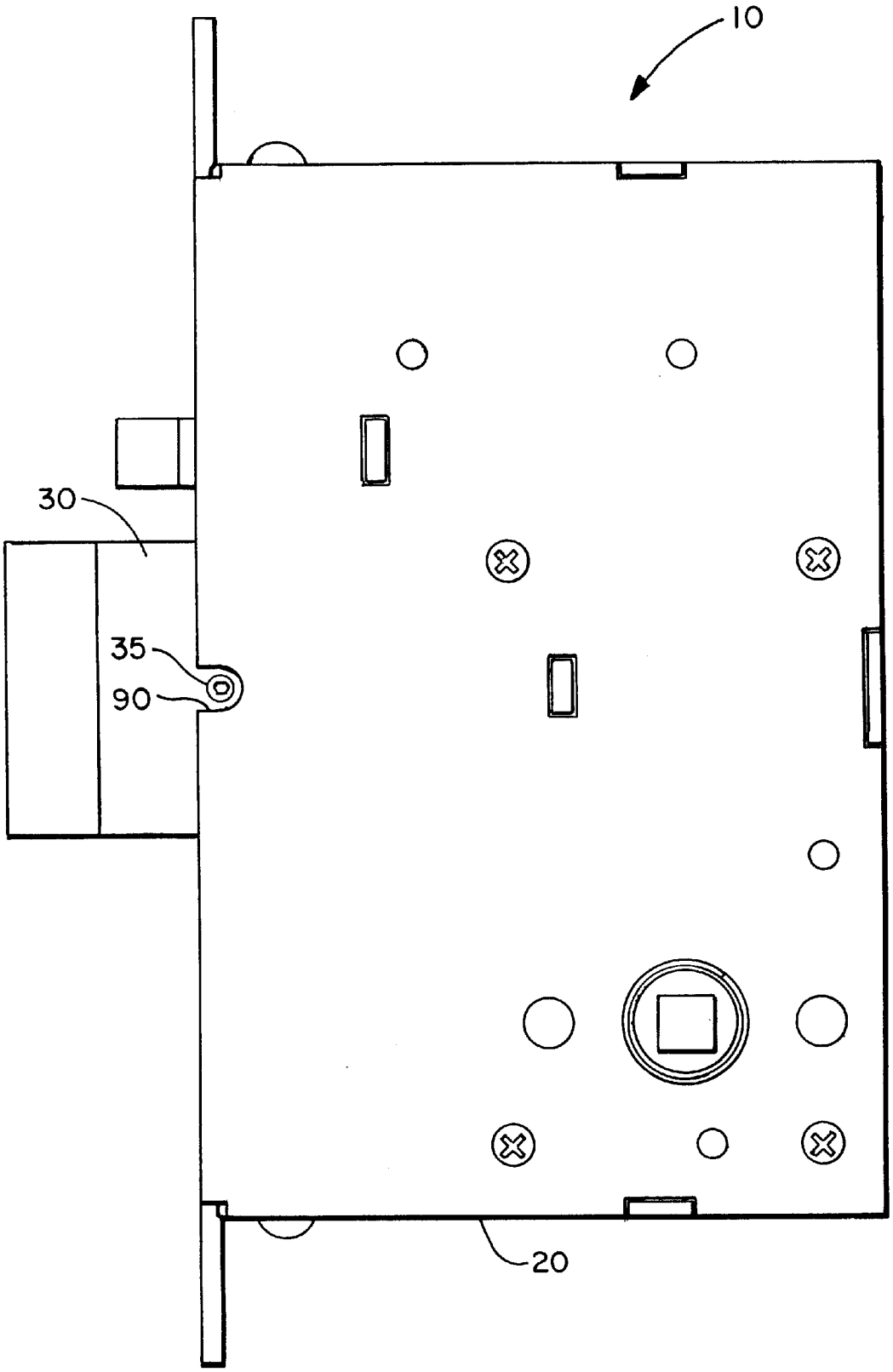
FIG. 6 is a side elevational view of the latch bolt set of FIG. 1 illustrating the bolt in a maximum projected position.
Figure 7A:
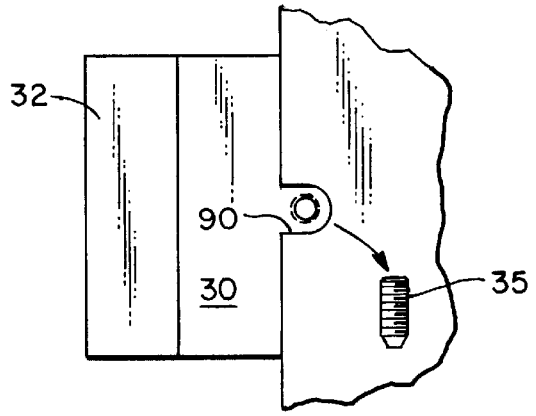
FIG. 7*a* is a fragmentary view, partly exploded and partly in schematic, illustrating a step in reversing the latch bolt.
Figure 7B:
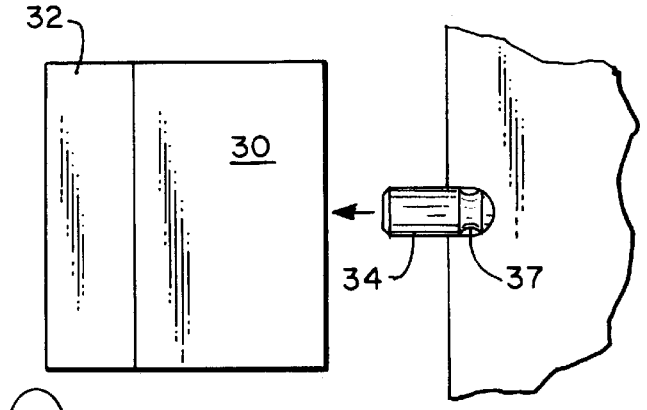
FIG. 7*b* is a second fragmentary side view, partly exploded and partly in schematic, illustrating a second step in reversing the latch bolt.
Figure 7C:
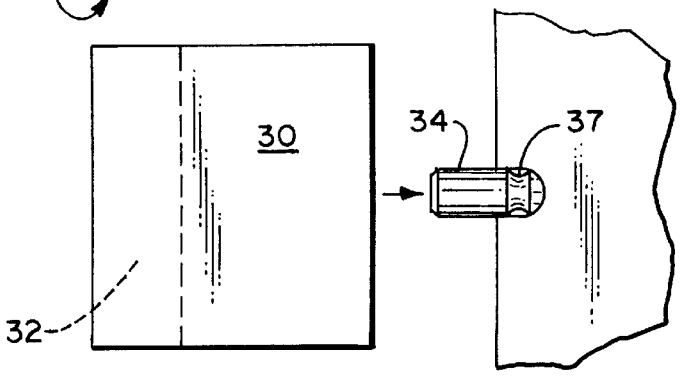
FIG. 7*c* is a third fragmentary side view, partly exploded and partly in schematic, illustrating a third step in reversing the latch bolt.
Figure 7D:
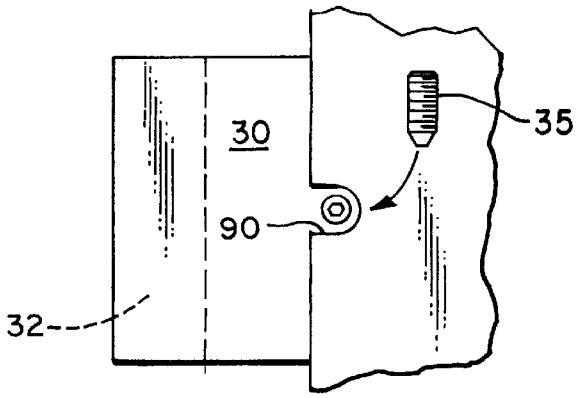
FIG. 7*d* is fourth fragmentary side view, partly exploded and partly in schematic, illustrating a fourth step in reversing the latch bolt.

With reference to FIGS. 6 and 7*a–d*, the latch bolt set is also adapted to be bi-handed. A central recess 90 is formed in the lock case to permit access to the set screw 35 when the latch bolt is in the projected position as illustrated in FIG. 6. With reference to FIG. 7*a*, the set screw 35 is removed from the latch bolt and the latch bolt 30 thus is permitted to be removed from its engagement with the throw rod 34 as illustrated in FIG. 7*b*. The bevel relationship on the latch bolt is then reversed in a manner equivalent to a 180° rotation about the axis of the throw rod 34, and the latch bolt is remounted to the throw rod. The set screw 35 is then re-engaged to secure the latch bolt to the throw rod with the latch bolt now being reversed for the opposite hand as opposed to the configuration of FIGS. 1–6. The latch bolt is therefore symmetric about a central plane through the latch bolt. It will be appreciated that the trigger bolt and the latch bolt are not required to be symmetrical about the plane through the latch case. The trigger bolt and latch bolt may be offset relative to the case center line. The width of the door and the position of the mortise of the door, in combination with the offset, determine the latch bolt and trigger bolt position. The position is determined so that the latch bolt aligns with the center line of the strike opening.

In addition, the associated strike 14 may be bi-handed. The strike opening is configured for symmetry about a transverse plane through the strike plate. Therefore, the same strike plate can be employed for left and right hand doors for reduced costs.

While a number of embodiments have been set forth for purposes of describing the invention, the foregoing descriptions are not a limitation of the invention. Accordingly, various modifications, adaptations and alternatives may also occur to one skilled in the art without departing from the spirit and the scope of the present invention.

I claim:

1. A latch bolt set comprising:

a lock case;

a latch bolt movably mounted relative to said case and having a retracted position, a projected position, and an intermediate position intermediate said projected and retracted positions;

latch bolt biasing means for biasing said latch bolt to said projected position;

trigger bolt means for releasably retaining said latch bolt in said intermediate position, said bolt means comprising a trigger bolt movably mounted to said case and having a retracted first position and a projected second position and a trigger lever operably connected to said trigger bolt;

trigger bolt biasing means for biasing said trigger bolt to said second position; and operator means for retracting said latch bolt from said projected position to said retracted position and for engaging with said trigger bolt means, said operator means including a throw rod defining a first end mounting said latch bolt and an opposing second end, said latch bolt biasing means surrounding said throw rod, wherein said operator means supports said latch bolt in said intermediate position when said trigger bolt is in said second position, and when said trigger bolt moves from said second position to said first position, said latch bolt is automatically allowed to move from said intermediate to said projected position.

2. The latch bolt set of claim 1 wherein said operator means further comprises lock means for locking said latch bolt in said projected position whereby said latch bolt can be moved to said retracted position solely by said operator means.

3. The latch bolt set of claim 2 wherein said lock means comprises a pivotable bar engageable with said latch bolt to lock said latch bolt in said projected position.

4. The latch bolt set of claim 1 wherein said latch bolt in cross-section defines a trapezoid having a beveled latch portion and a dead bolt portion, said latch portion extending from said case and said dead bolt portion disposed in said case when said latch bolt is in said intermediate position, and said dead bolt portion extending from said case when said latch bolt is in said projected position.

5. The latch bolt set of claim 4 wherein said trigger bolt has an end portion defining a bevel.

6. The latch bolt set of claim 1 wherein said operator means includes a rotatable spindle, a lever arm fixed to said spindle and said throw rod second end is engaged by said lever arm whereby rotation of said spindle retracts said latch bolt.

7. The latch bolt set of claim 6 wherein said latch bolt biasing means comprises a coil spring positioned around said throw rod.

8. The latch bolt set of claim 6 wherein said latch bolt is configured to be mountable to said throw rod in a first latch orientation for a left hand door and repositionable to be mountable to said throw rod in a second latch orientation for a right hand door.

9. The latch bolt set of claim 6 wherein said lever arm defines an engagement surface and said trigger lever is pivotable for engagement with said engagement surface to maintain said latch bolt in said intermediate position when said trigger bolt is in said second position, said trigger bolt further pivoting said trigger lever when said trigger bolt moves to said first position thereby disengaging said trigger lever from said lever arm to allow said latch bolt to move to said projected position.

10. The latch bolt set of claim 6 wherein said operator means further comprises pivotable bar means for locking said latch bolt in said projected position whereby said latch bolt can be moved to said retracted position solely by said operator means.

11. The latch bolt set of claim 10 wherein said lock bar means comprises a pivotable lock bar having an engagement end engageable to said latch bolt in said projected position, and further comprising a pin mounted to said lever arm, said lock bar slidingly engaging said pin whereby said pin pivots said lock bar to engage said lock bar with said latch bolt in said projected position, and allows said lock bar to pivot to disengage from said latch bolt when said lever arm is rotated.

12. A doorway assembly comprising:

a door frame defining a door opening;

a door strike mounted to said door frame defining a latch bolt opening for receiving a latch bolt and a strike surface;

a door swingably mounted to said door frame for selectively closing across said door opening and defining a mortise opposite said strike when said door is closed; and a latch bolt set mounted in said mortise for selectively locking said door to said door frame, comprising:

latch bolt means having a latch bolt extendable from said door for engagement into said strike opening, said latch bolt having a retracted position wherein said door can be opened, a projected position wherein the latch bolt is engaged into said strike opening when said door is closed, and an intermediate position intermediate said retracted and projected positions;

latch bolt biasing means for biasing said latch bolt to said projected position;

a trigger bolt mechanism engageable with said strike surface when said door is in said closed position comprising a trigger bolt having a retracted first position within said door when said door is closed and said trigger bolt engages said strike surface, and a projected second position projecting from said door when said door is open and a trigger lever operably connected to said trigger bolt;

trigger bolt biasing means for biasing said trigger bolt to said second position; and operator means for moving said latch bolt between said projected and retracted positions and for engaging with said trigger bolt mechanism, said operator means including a throw rod defining a first end mounting said latch bolt and an opposing second end, said latch bolt biasing means surrounding said throw rod, wherein said operator means supports said latch bolt in said intermediate position when said door is open and said trigger bolt is in said second position, and when said trigger bolt engages said strike surface, said trigger bolt moves from said second position to said first position thereby allowing said latch bolt biasing means to move said latch bolt to said projected position into said strike opening when said door is closed.

13. The doorway assembly of claim 12 wherein said latch bolt defines in cross-section a trapezoid having a beveled latch portion and a dead bolt portion, said latch portion extending from said door and said dead bolt portion being disposed in said door when said latch bolt is in said intermediate position, and said dead bolt portion extending from said door when said latch bolt is in said projected position.

14. The doorway assembly of claim 12 wherein said operator means comprises pivotable lock means for locking said latch bolt in said projected position whereby said latch bolt can be moved to said retracted position solely by said operator means.

15. The doorway assembly of claim 14 wherein said lock means comprises a lock bar engageable with said latch bolt to lock said latch bolt in said projected position.

16. A latch bolt set comprising:

a lock case;

a latch bolt movably mounted to said case, said latch bolt having a projected position, a retracted position, and an intermediate position intermediate said projected and retracted positions;

latch bolt biasing means for biasing said latch bolt to said projected position;

trigger bolt means for releasably retaining said latch bolt in said intermediate position, said trigger bolt means comprising a trigger bolt movably mounted to said case having a retracted first position and a projected second position and a trigger lever operably connected to said trigger bolt;

trigger bolt biasing means for biasing said trigger bolt to said second position; and operator means for retracting said latch bolt from said projected position to said retracted position, said operator means comprising a spindle rotatably mounted relative to said case, a lever arm having an end portion fixed to said spindle for motion thereby, and a throw rod having a first end portion connected to said latch bolt and a second end portion engaged by said lever arm, said latch bolt biasing means surrounding said throw rod, so that rotation of said spindle moves said latch bolt between said projected and retracted positions, and wherein said trigger bolt means is engageable with said operator means to support said latch bolt in said intermediate position when said trigger bolt is in said second position, and when said trigger bolt is moved to said first position, said latch bolt is allowed to move to said projected position.

17. The latch bolt set of claim 16 wherein said latch bolt is selectively mountable to said first end portion in a first latch orientation for a right hand door and repositionable and selectively mountable to said first end portion in a second latch orientation for a left hand door.

18. The latch bolt set of claim 16 wherein said latch bolt biasing means comprises a coil spring around said throw rod.

19. The latch bolt set of claim 16 wherein said trigger lever is pivotable and said lever arm further defines an engagement surface, said trigger lever having a first position wherein said trigger lever engages said engagement surface when said trigger bolt means supports said latch bolt in said intermediate position, and a second position wherein said trigger lever is disengaged from said engagement.

20. The latch bolt set of claim 19 wherein said trigger bolt means further comprises a trigger rod having a first end mounting said trigger bolt, and a second end engaging said trigger lever, said trigger rod pivoting said trigger lever from said first position to said second position when said trigger bolt is moved from said second position to said first position.

21. The latch bolt set of claim 16 wherein said latch bolt in cross-section defines a trapezoid having a beveled latch portion and a dead bolt portion, said latch portion extending from said case and said dead bolt portion being disposed in said case when said latch bolt is in said intermediate position, and said dead bolt portion extending from said case when said latch bolt is in said projected position.

22. The latch bolt set of claim 16 wherein said operator means further comprises pivotable lock bar means for locking said latch bolt in said projected position whereby said latch bolt can be moved to said retracted position solely by said operator means.

23. The latch bolt set of claim 22 wherein said lock bar means comprises a pivotable lock bar having an engagement end engageable with said latch bolt in said projected position, and a pin mounted to said lever arm, said lock bar slidingly engaging said pin whereby said pin pivots said lock bar to engage said latch bolt in said projected position, and allows said lock bar to pivot to disengage from said latch bolt when said lever arm is rotated.

24. The latch bolt set of claim 16 wherein said latch bolt and said throw rod define a central plane and said latch bolt and said throw rod are symmetric about said central plane.

25. The latch bolt set of claim 16 wherein said throw rod defines an axis and latch bolt is mountable to said throw rod in a first latch orientation and is mountable to said throw rod in a second latch orientation wherein said second latch orientation is rotated about 180° about said axis from said first latch orientation.

* * * * *

UNITED STATES PATENT AND TRADEMARK OFFICE

CERTIFICATE OF CORRECTION

PATENT NO. : 6,045,169
APPLICATION NO. : 08/860080
DATED : April 4, 2000
INVENTOR(S) : Frolov It is certified that error appears in the above-identified patent and that said Letters Patent is hereby corrected as shown below:

column 6, claim 1, line 21 before “bolt” insert --trigger--.

Signed and Sealed this

Twenty-second Day of August, 2006

JON W. DUDAS
*Director of the United States Patent and Trademark Office*